US008017882B2

(12) United States Patent
Yang et al.

(10) Patent No.: US 8,017,882 B2
(45) Date of Patent: Sep. 13, 2011

(54) SIDE KEY ASSEMBLY FOR PORTABLE ELECTRONIC DEVICE

(75) Inventors: Mu-Wen Yang, Taipei Hsien (TW); Chih-Chiang Chang, Taipei Hsien (TW)

(73) Assignee: FIH (Hong Kong) Limited, Kowloon (HK)

( * ) Notice: Subject to any disclaimer, the term of this patent is extended or adjusted under 35 U.S.C. 154(b) by 316 days.

(21) Appl. No.: 12/478,011

(22) Filed: Jun. 4, 2009

(65) Prior Publication Data

US 2009/0301854 A1 Dec. 10, 2009

(30) Foreign Application Priority Data

Jun. 6, 2008 (CN) ..... 2008 1 0302062

(51) Int. Cl.
*H01H 13/00* (2006.01)

(52) U.S. Cl. ..... 200/343

(58) Field of Classification Search ..... 200/341–345, 200/339

See application file for complete search history.

(56) References Cited

U.S. PATENT DOCUMENTS

| | | | | |
|---|---|---|---|---|
| 4,401,864 | A * | 8/1983 | Ichikawa | 200/17 R |
| 4,689,455 | A * | 8/1987 | Watanabe | 200/5 A |
| 5,332,874 | A * | 7/1994 | Orr et al. | 200/5 B |
| 6,239,726 | B1 * | 5/2001 | Saida | 200/344 |
| 6,930,264 | B2 * | 8/2005 | Nagai et al. | 200/252 |
| 7,094,983 | B2 * | 8/2006 | Tsunemoto | 200/339 |
| 7,208,692 | B2 * | 4/2007 | Yamaguchi | 200/329 |
| 7,385,150 | B1 * | 6/2008 | Siddiqui et al. | 200/5 A |
| 7,554,050 | B1 * | 6/2009 | Lv | 200/339 |
| 7,800,008 | B2 * | 9/2010 | Shi et al. | 200/547 |
| 7,884,297 | B2 * | 2/2011 | Okuzumi | 200/339 |
| 7,916,459 | B2 * | 3/2011 | Lee et al. | 361/679.01 |
| 2008/0088489 | A1 * | 4/2008 | Moon | 341/22 |
| 2008/0264768 | A1 * | 10/2008 | Shi et al. | 200/344 |
| 2009/0152088 | A1 * | 6/2009 | Fujiwara | 200/343 |

* cited by examiner

*Primary Examiner* — Briggitte R Hammond
(74) *Attorney, Agent, or Firm* — Altis Law Group, Inc.

(57) ABSTRACT

A side key assembly includes a base plate, a mounting shaft and two push buttons. The base plate has an opening defined therein and a sidewall formed in the opening. The mounting shaft is rotatably mounted on the base plate and received in the opening of the base plate. The two push buttons is rotatably received in the opening and respectively resisting against two opposite sides of the mounting shaft.

20 Claims, 5 Drawing Sheets

SIDE KEY ASSEMBLY FOR PORTABLE ELECTRONIC DEVICE

CROSS-REFERENCE TO RELATED APPLICATIONS

This application is related to co-pending U.S. patent application Ser. No. 12/478,009, entitled "SIDE KEY ASSEMBLY FOR PORTABLE ELECTRONIC DEVICE", by Mu-Wen Yang et al. Such application has the same assignee as the present application and has been concurrently filed herewith. The above-identified application is incorporated herein by reference.

BACKGROUND

1. Technical Field

The present disclosure generally relates to side key assemblies, and particularly to side key assemblies used in portable electronic devices.

2. Description of Related Art

With the development of the smaller and lighter electronic devices for portable use, side key assemblies become more compact with individual keys more tightly spaced. Unfortunately, users of these portable electronic sometimes experience difficulty in activating keys that are close together; multiple and/or erroneous keys may be activated at the same time. This drawback exists not only in cellular telephones, but other portable electronic devices with side key assemblies. Also, keys on the side key assemblies can be too crowded to allow quick, accurate activation.

Thus, there is room for improvement within the art.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the exemplary side key assembly and portable electronic device using side key assembly. Moreover, in the drawings like reference numerals designate corresponding parts throughout the several views. Wherever possible, the same reference numbers are used throughout the drawings to refer to the same or like elements of an embodiment.

DETAILED DESCRIPTION

Figure 1:
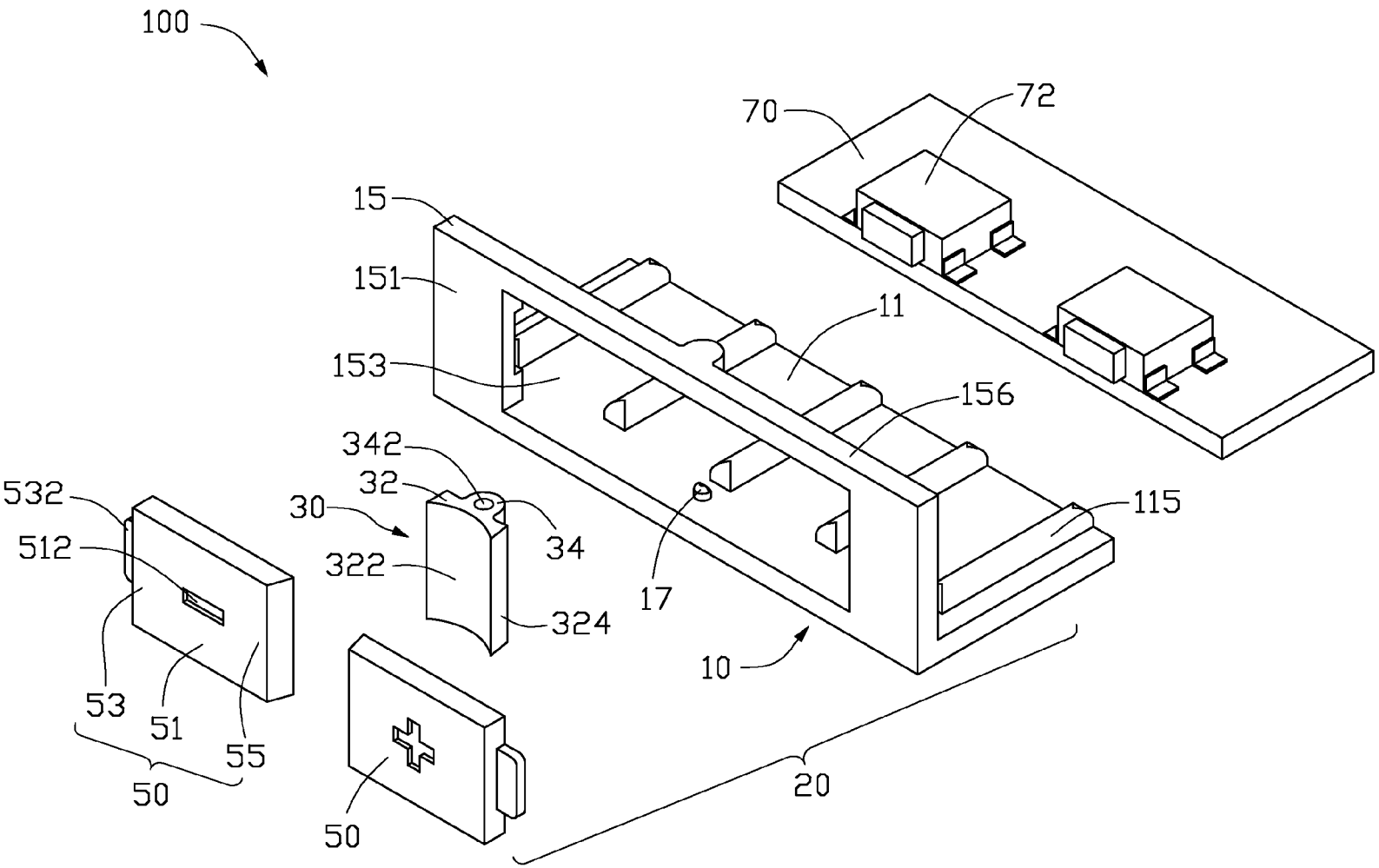
FIG. 1 is an exploded, isometric view of one embodiment of a side key assembly used in a portable electronic device, the portable electronic device including the side key assembly, a housing, and a circuit board.
Figure 2:
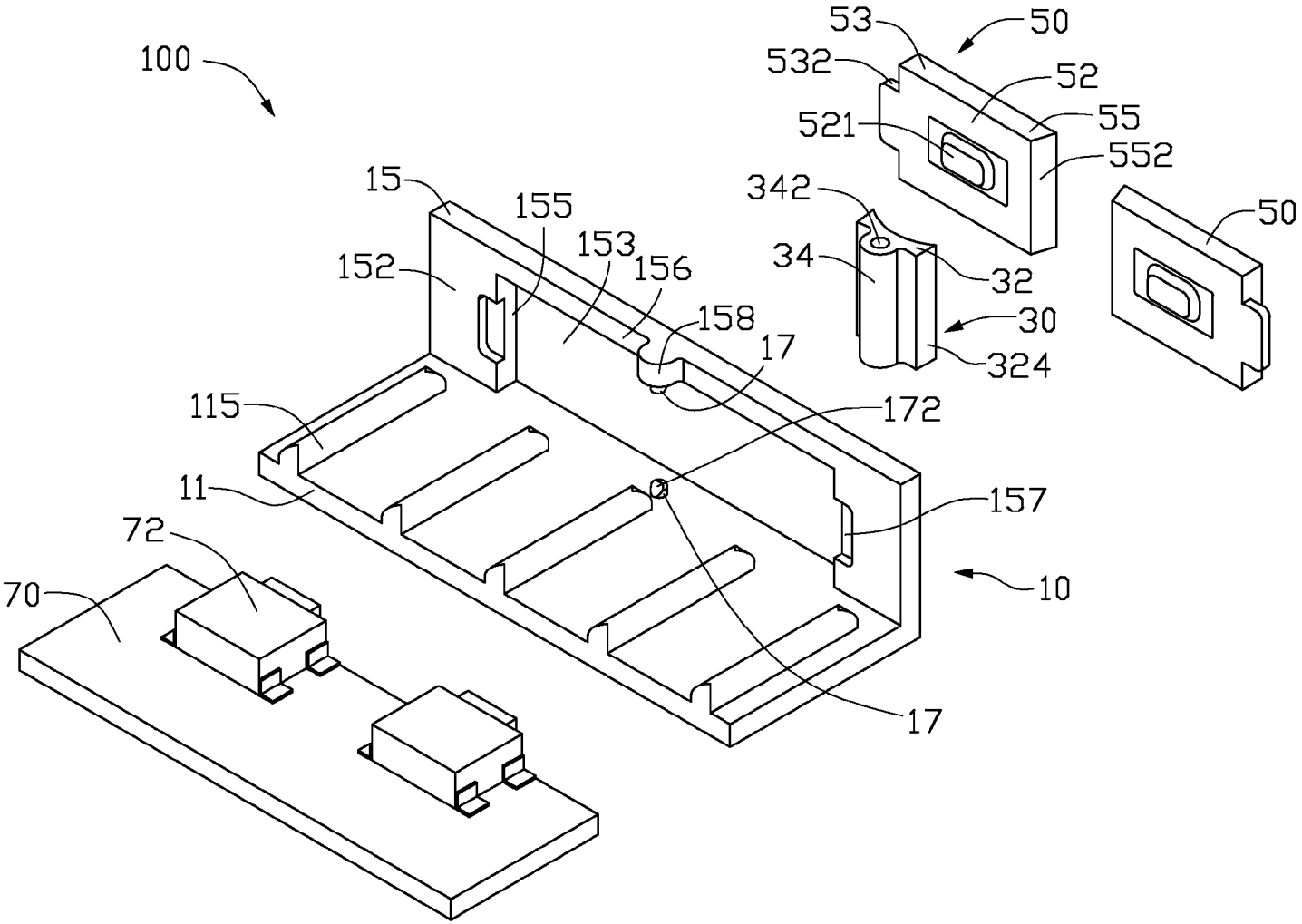
FIG. 2 is similar to FIG. 1, but showing the portable electronic device in another aspect.
Figure 3:
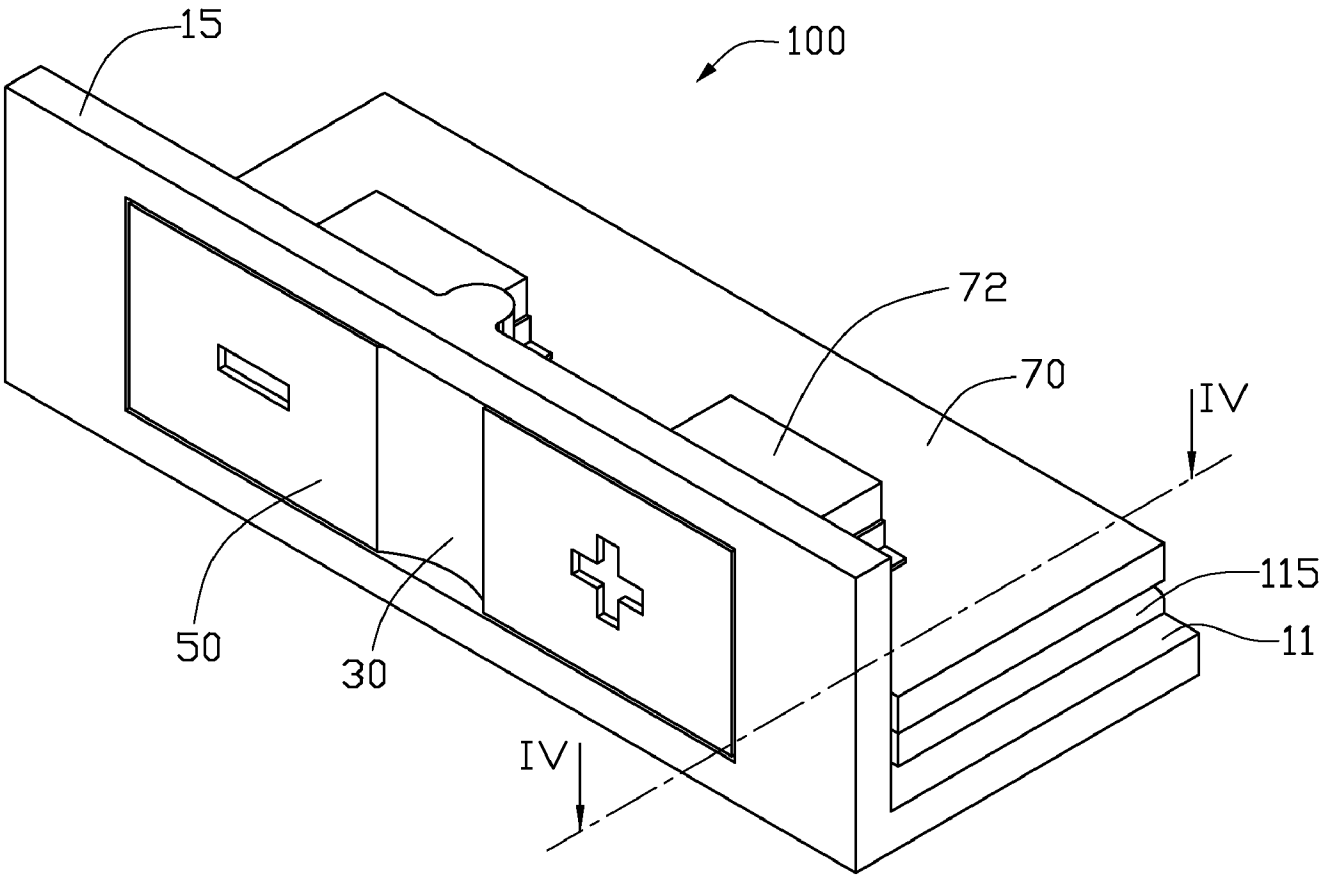
FIG. 3 is an assembled view of the portable electronic device shown in FIG. 1.

Referring to FIGS. 1 to 3, an embodiment of a side key assembly 20 can be used on a portable electronic device 100, such as a cellular phone or any electronic device where a side key is desirable. The portable electronic device 100 includes a side key assembly 20, and a circuit board 70. The exemplary circuit board 70 has two spaced apart switches 72 mounted thereon. The side key assembly 20 is configured for pressing the switches 72.

The side key assembly 20 includes a base plate 10 and push buttons 50 corresponding to the switches 72, and a mounting shaft 30 between the push buttons 50. The base plate 10 may be a portion of a housing of the portable electronic device 100 or may be a separate element mounted to the housing of the portable electronic device 100. In this embodiment, the base plate 10 is a portion of the housing of the portable electronic device 100. The number of push buttons 50 is the same as the number of switches 72. As will be described below, the mounting shaft 30 can be compressed to facilitate pressing the push buttons 50. While each push button 50 is shown herein as substantially rectangular, other shapes such as trapezoidal, inverted parabolic, or semi-circular may be substituted. Each push button 50 has a first surface 51 facing the outside of the personal electronic device 100, a second surface 52 opposite to the first surface 51, a first end portion 53, and a second end portion 55 opposite to the first end portion 53.

The first surface 51 is an operating surface of the push button 50. The first surface 51 may have a indicia 512 defined thereon, to indicate the function of the push button 50. The indicia 512 may be, e.g., a "+" or "−", to indicate increasing volume function or decreasing volume function, correspondingly. The second surface 52 has a push portion 521 protruding from substantially the center thereof. The push portion 521 may be constructed from injection-molded thermoplastic elastomer and constructed to produce a point contact sensation in a user's fingertip to provide tactile feedback when a user presses the push button 50.

The first end portion 53 has a stopping section 532 protruding outwardly therefrom. The stopping section 532 is configured for preventing the push button 50 from detaching from the base plate 10. The second end portion 55 is located adjacent to the mounting shaft 30 and has a wedged wall 552 facing the mounting shaft 30.

The mounting shaft 30 may be an elastic member made from an injection-molded thermoplastic elastomer. The mounting shaft 30 includes a resisting section 32 and a retaining section 34 protruding outwardly from a surface of the resisting section 32. The resisting section 32 has a slot 322 defined in another surface thereof. The slot 322 is curved and configured to decrease the structural strength of the resisting section 32, so that the resisting section 32 can be easily bent under an external force. The resisting section 32 has two opposite side surfaces 324, and each side surface 324 is wedge shaped for corresponding to the wedged wall 552 of the push button 50. The retaining section 34 has a hole 342 defined in each opposite end thereof. The holes 342 are configured for fixing the mounting shaft 30 to the base plate 10.

The base plate 10 includes a bottom wall 11 and a peripheral wall 15 perpendicularly connected to the bottom wall 11. The bottom wall 11 is used for mounting the circuit board 70 thereon. The peripheral wall 15 has an outer surface 151 and an inner surface 152 opposite to the outer surface 151. The peripheral wall 15 defines an opening 153 through the outer surface 151 and the inner surface 152. Thus, two sidewalls 155 perpendicular to the bottom wall 11 are defined , and a beam 156 parallel to and spaced-from the bottom wall 11 is defined. The opening 153 is configured for accommodating the side key assembly 20.

Each sidewall 155 has a groove 157 defined therein, and the grooves 157 communicate with the inner surface 152 of the peripheral wall 15. The grooves 157 correspond to the stopping sections 532 of the side key assembly 20. The grooves 157 have the same shape and size as the stopping sections 532, thus the stopping sections 532 may be received in the grooves 157 to prevent the push button 50 from detaching from the opening 153 of the base plate 10.

The peripheral wall 15 has a retaining portion 158 protruding from the inner wall 152 on the beam 156. The base plate 10 further includes two columnar symmetrical poles 17, one of which protrudes from the side of the retaining portion 158 and faces the bottom wall 11, and the other of which protrudes from the bottom wall 11 of the base plate 10. The poles 17 are accommodated in the holes 342 of the mounting shaft 30 to assemble the mounting shaft 30 to the base plate 10. Each pole 17 has a wedged surface 172 defined at an inner side thereof. The wedged surfaces 172 facilitate accommodating the poles 17 in the holes 342 of the mounting shaft 30.

Figure 4:
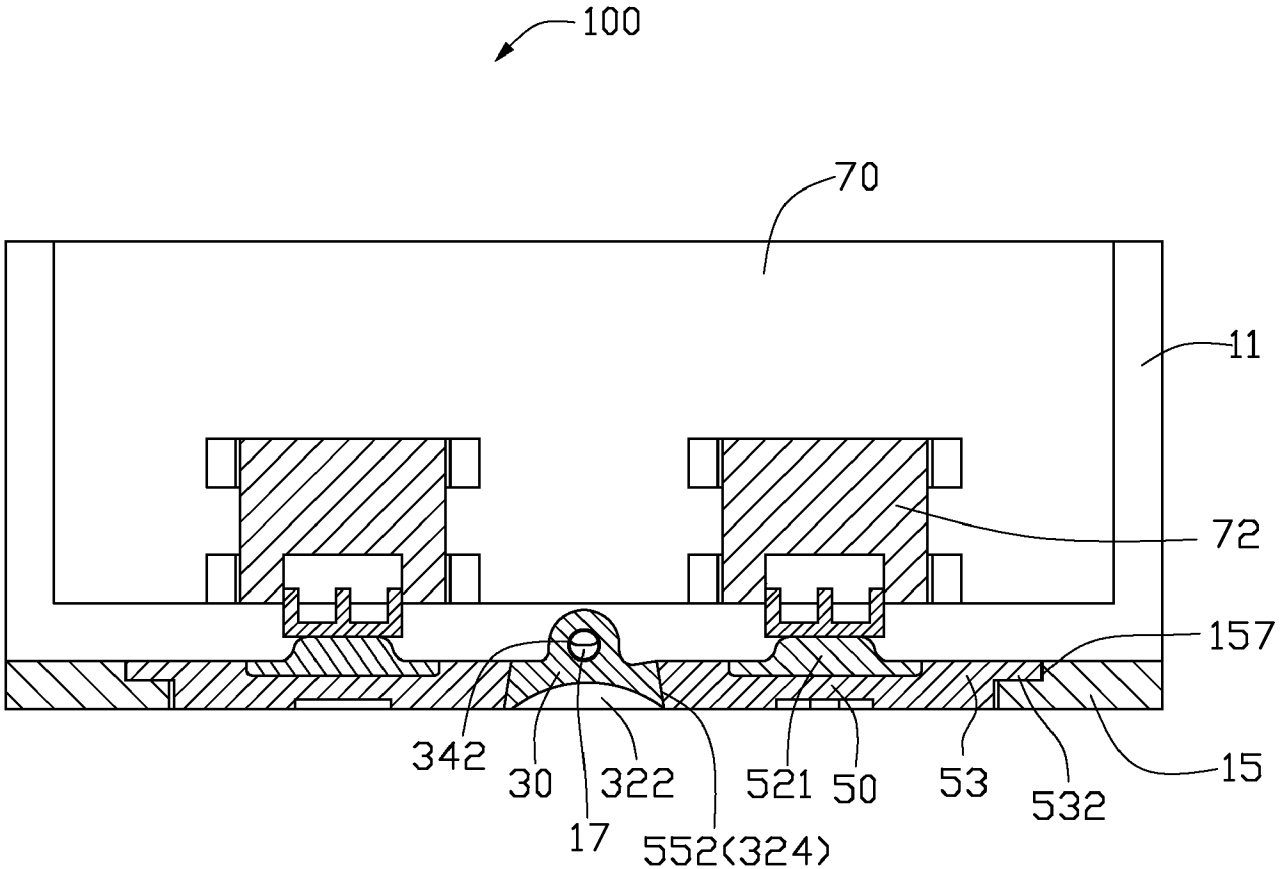
FIG. 4 is a cross sectional of the portable electronic device along the line of IV-IV shown in FIG. 3

Referring to FIG. 4, to assemble the portable electronic device 100, firstly, the mounting shaft 30 is put in the base plate 10 and the holes 342 of the mounting shaft 30 are aligned with the poles 17. Then, the mounting shaft 30 is pressed toward the peripheral wall 15. During this stage, the two opposite ends of the mounting shaft 30 respectively move along the wedged surface 172 and bend/deflect the poles 17, so when each pole 17 returns to its original state, it slides into a corresponding hole 342. Thus, the mounting shaft 30 is assembled to the base plate 10 and located in the opening 153. At this time, the wedges walls 324 of the mounting shaft 30 correspondingly face the sidewalls of the base plate 10.

The push buttons 50 are accommodated in the opening 153. The stopping portions 532 of the push buttons 50 are latched in the grooves 157 of the base plate 10 to prevent the first end portions 53 of the push buttons 50 from detaching from the opening 153. Additionally, the first end portions 53 of the push buttons 50 resist against the sidewalls 155 of the base plate 10 and the wedged walls 552 of the push buttons 50 resist against the side surfaces 324 of the mounting shaft 30, i.e., the push buttons 50 are held between the sidewalls 155 and the wedged walls 552. Because the wedged walls 552 and the side surfaces 324 are both wedge-shaped, the resisting engagement between the wedged walls 552 and the side surfaces 324 can prevent the second end portions 55 of the push buttons 50 from detaching from the openings 153.

Then, the circuit board 70 is mounted to the bottom wall 11 of the base plate 10, thus forming an assembled portable electronic device 100. At this time, the switches 72 on the circuit board 70 are correspondingly biased against the push portions 521 of push buttons 50, which aids in preventing the push buttons 50 detaching from the opening 153.

Figure 5:
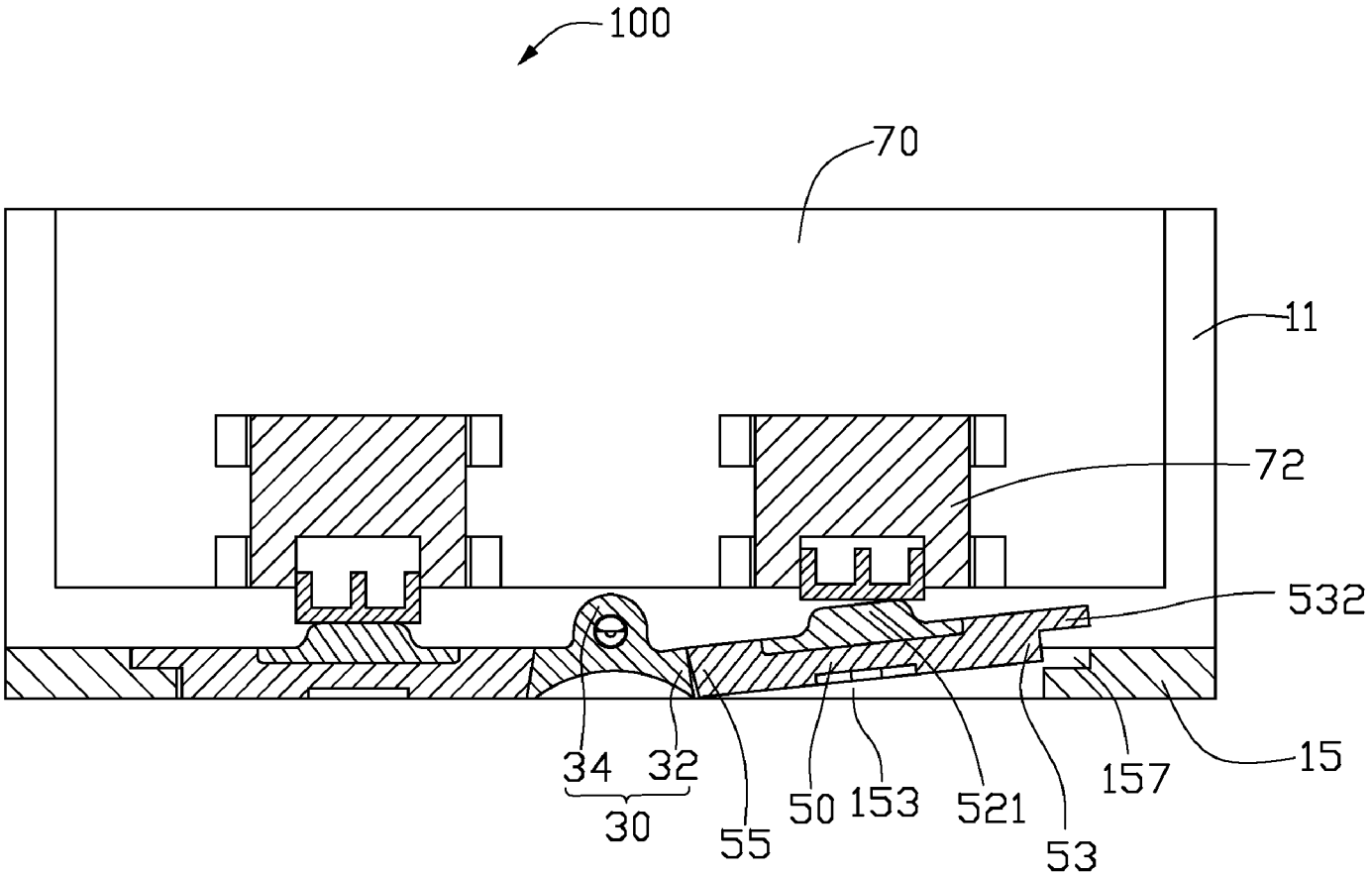
FIG. 5 is similar to FIG. 4, but a key is pressed to a switch.

FIG. 5 shows one of the buttons 50 as being pushed, and while the action of only one button is described herein, the action applies to any number of push buttons 50. When using the side key assembly 20, the first end portion 53 of the push button 50 is pressed toward the switch 72 of the circuit board 70, rotating the push button 50 about the second end portion 55. As the push button 50 rotates, the mounting shaft 30 is compressed by the rotating push button 50 so that the push button 50 can freely rotate in the opening 153. The first end portion 53 is continuously pressed to make the first end portion 53 rotate out of the opening 153, until the push portion 521 of the push button 50 triggers the switch 72 to control the circuit board 70. Then the first end portion 53 of the push button 50 is released. The push button 50 reversely rotates about the second end portion 55 until the first end portion 53 returns back into the opening 153, and the stopping portion 532 is latched in the groove 157 to prevent the first end portion 53 from moving away from the base plate 10.

The push buttons 50 of the side key assembly 20 are spaced apart by the mounting shaft 30, such that a user's fingertip touches only one push button 50 at a time, thus reducing the possibility of hitting two keys at once. Also, the mounting shaft 30 can be compressed when the push button 50 is pressed, thus the side key assembly 20 has a good tactile sensing for a user's finger. Additionally, compressing the mounting shaft 30 allows for quick accurate depression of the side key assembly 20.

It is to be understood, however, that even though numerous characteristics and advantages of the embodiments have been set forth in the foregoing description, together with details of the structure and function of the disclosure, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A side key assembly comprising:

a base plate defining an opening having a sidewall;

a mounting shaft, the mounting shaft rotatably mounted on the base plate and received in the opening of the base plate; and two push buttons, the two push buttons rotatably received in the opening and respectively resisting against two opposite sides of the mounting shaft.

2. The side key assembly of claim 1, wherein each push button comprising a first end portion and a second end portion located opposite to the first end portion, the mounting shaft has a wedged side surface facing the sidewall of the base plate, the first end portion resists against the sidewall, and the second end portion has a wedged wall resisting against the wedged side surface of elastic member, thus each push button being hold between the sidewall and the wedged side surface.

3. The side key assembly of claim 2, wherein the first end portion has a stopping portion protruding outwardly, the base plate has a groove defined in the sidewall and corresponding to the stopping portion, the stopping portion is latched in the groove to prevent the first end portion from detaching from the opening.

4. The side key assembly of claim 3, wherein the base plate includes a bottom wall and a peripheral wall perpendicularly connected with the bottom wall, the opening is defined through the peripheral wall.

5. The side key assembly of claim 4, wherein the mounting shaft has two holes respectively defined in the two opposite ends thereof, the base plate has two poles corresponding to the holes, the poles are accommodated in the holes to assemble the elastic member to the base plate.

6. The side key assembly of claim 5, wherein a beam is defined in the opening and situated parallel to and spaced from the bottom wall, the peripheral wall has a retaining portion protruding from the inner wall on the beam, one of the pole protrudes from a side of the retaining portion and faces the bottom wall, another pole protrudes from the bottom wall of the base plate.

7. The side key assembly of claim 5, wherein the mounting shaft includes a substantially rectangular resisting section and a retaining section protrudes outwardly from a surface of resisting section, the retaining section has two opposite ends, the holes are defined in the two opposite ends of the retaining section.

8. The side key assembly of claim 7, wherein the mounting shaft has a slot defined in another surface of the resisting section, so that the resisting section be easily compressed under an exterior force.

9. The side key assembly of claim 7, wherein each push button has a push portion protruding from a surface thereof, the push portion is constructed to produce a point contact sensation.

10. A side key assembly, comprising:

a base plate, the base plate defining an opening having a sidewall;

an elastic member, the elastic member rotatably mounted on the base plate and received in the opening of the base plate; and a push button, the push button rotatably accommodated in the opening and being held between the sidewall and the elastic member.

11. The side key assembly of claim 1, wherein the push button comprising a first end portion and a second end portion located opposite to the first end portion, the elastic member has a wedged side surface facing the sidewall of the base plate, the first end portion resists against the sidewall, and the second end portion has a wedged wall resisting against the wedged side surface of elastic member, the push button being hold between the sidewall and the wedged side surface.

12. The side key assembly of claim 11, wherein the first end portion has a stopping portion protruding outwardly, the base plate has a groove defined in the sidewall and corresponding to the stopping portion, the stopping portion is latched in the groove to prevent the first end portion from detaching from the opening.

13. The side key assembly of claim 12, wherein the base plate includes a bottom wall and a peripheral wall perpendicularly connected with the bottom wall, the opening is defined through the peripheral wall.

14. The side key assembly of claim 13, wherein the elastic member has two holes respectively defined in the two opposite ends thereof, the base plate has two poles corresponding to the holes, the poles are accommodated in the holes to assemble the elastic member to the base plate.

15. The side key assembly of claim 14, wherein a beam is defined in the opening and situated parallel to and spaced from the bottom wall, the peripheral wall has a retaining portion protruding from the inner wall on the beam, one of the pole protrudes from a side of the retaining portion and faces the bottom wall, another pole protrudes from the bottom wall of the base plate.

16. The side key assembly of claim 14, wherein the elastic member includes a substantially rectangular resisting section and a retaining section protrudes outwardly from a surface of resisting section, the retaining section has two opposite ends, the holes are defined in the two opposite ends of the retaining section.

17. The side key assembly of claim 16, wherein the elastic member has a slot defined in another surface of the resisting section, so that the resisting section be easily compressed under an exterior force.

18. The side key assembly of claim 16, wherein the push-button has a push portion protruding from a surface thereof, the push portion is constructed to produce a point contact sensation.

19. A portable electronic device, comprising:

a circuit board having switches mounted thereon; and a side key assembly including:

a base plate, the base plate defining an opening having a sidewall;

elastic member, the elastic member rotatably mounted on the base plate and received in the opening of the base plate;

two buttons, the two buttons rotatably received in the opening, and used to control the switches of the circuit board, the buttons respectively resisting against two opposite sides of the elastic member.

20. The portable electronic device of claim 19, wherein the base plate includes a bottom wall and a peripheral wall perpendicularly connected with the bottom wall, the opening is defined through the peripheral wall, the sidewall is situated perpendicularly to the bottom wall, the circuit board is mounted onto the bottom wall and adjacent the peripheral wall.

* * * * *